US008461440B1

(12) United States Patent
Stephenson

(10) Patent No.: US 8,461,440 B1
(45) Date of Patent: Jun. 11, 2013

(54) QUICK CHANGE DRUM HEAD ASSEMBLY

(76) Inventor: Dwayne K. Stephenson, Gray, TN (US)

( * ) Notice: Subject to any disclaimer, the term of this patent is extended or adjusted under 35 U.S.C. 154(b) by 0 days.

(21) Appl. No.: 13/507,173

(22) Filed: Jun. 11, 2012

Related U.S. Application Data

(60) Provisional application No. 61/520,388, filed on Jun. 9, 2011.

(51) Int. Cl.
*G10D 13/02* (2006.01)

(52) U.S. Cl.
USPC ..... 84/411 R

(58) Field of Classification Search
USPC ..... 84/411 R, 413–415, 421
See application file for complete search history.

(56) References Cited

U.S. PATENT DOCUMENTS 7,825,318 B2 * 11/2010 Ito ..... 84/411 R
2007/0251373 A1 * 11/2007 Fadda ..... 84/411 R

* cited by examiner

*Primary Examiner* — Kimberly Lockett

(57) ABSTRACT

A musical instrument fitted with a quick change percussion drum head/tuner assembly wherein, e.g., a conventional snare drum is provided on the open top end of its shell with a base ring of the assembly, a drum head/tuner unit of an adapter ring, percussion membrane and tuner ring is removably locked onto the base ring, and wherein said base ring is affixed to the shell by means of the conventional tie-down screw and nut mechanism secured to the exterior surface of the shell.

5 Claims, 6 Drawing Sheets

QUICK CHANGE DRUM HEAD ASSEMBLY

This application claims priority under 35 U.S.C. 119(e)(1) based on Applicants Provisional U.S. Patent Application Ser. No. 61/520,388 filed Jun. 9, 2011 of same title.

BACKGROUND OF THE INVENTION

1. Field of the Invention

This invention pertains to a unique drum head assembly for use on snare drums or the like and particularly to a means for mounting the unique drum head assembly on conventional drums without having to modify the shell structure or the conventional shell side mounted tie down screws which secure the conventional drum head to the top of the shell wall.

2. Prior Art

As an example, typical snare drum structure comprises a cylindrical shell with each open end covered by a vibration membrane such as shown for example, in U.S. Pat. No. 4,362,681, the disclosure of which is hereby incorporated herein by reference in its entirety, which membrane is held in place over the end of the drum shell by rim means mounted over the periphery of the membrane and by threaded tie down screws threaded at their lower ends into nut members permanently affixed to the outside of the shell and abutting the rim means at their upper ends. Tightening these screws stretches the membrane tighter across the top end of the shell and varies the sound pitch, i.e., tunes the drum.

Typically, removal of a drum membrane from the drum shell requires removal of each of the tie-down screws from the drum rim whereby the drum head can be lifted off the end of the drum shell. A new or replacement drum membrane may then be placed over the end of the drum shell and secured thereto by the rim means and tightening (tuning) screws. The new drum membrane must then be tightened (tuned) to give the drum the desired pitch.

As stated in U.S. Pat. No. 3,533,324 "In replacing the drum skin of a conventional drum, it is precisely the removal and replacement of the tuning screws which absorbs the operator's time. Depending upon the skill and dexterity of the drummer, it generally takes from 5 to 15 minutes to replace the drum head of a conventional musical drum. This delay is of obvious disadvantage to the drummer, especially if the drum skins must be changed during a musical performance. Even during the leisure hours of the drummer, the present method of changing drum heads is clearly both endious and undesirably time consuming.

The present quick change unit allows the drum head with membrane to be quickly removed and replaced with another pretuned head and membrane in a matter of seconds.

SUMMARY OF THE INVENTION

The present invention in a preferred embodiment can be summarized as a drum head quick change assembly having a base ring means which replaces the standard top tuner rim of a conventional drum and which has on its upper surface a first component of a quick release mechanism, which base ring fits onto the upper end of a conventional drum shell (cylinder) and is fastened thereto by means of the typical tie-down (tuner) screws and nuts already affixed to the exterior of the drum shell, and which assembly further has a replacement, quick change drum head/tuner unit comprising a percussion membrane mounted on a tuner structure isolated from the drum shell and which is provided with a second component of said quick release mechanism whereby the unit can be quickly replaced with another unit which can be pre-tuned if desired.

The invention will be further understood from the drawings herein and their description, wherein certain structures are enlarged for clarity and wherein the various figures are not necessarily in the same proportions:

Figure 1:
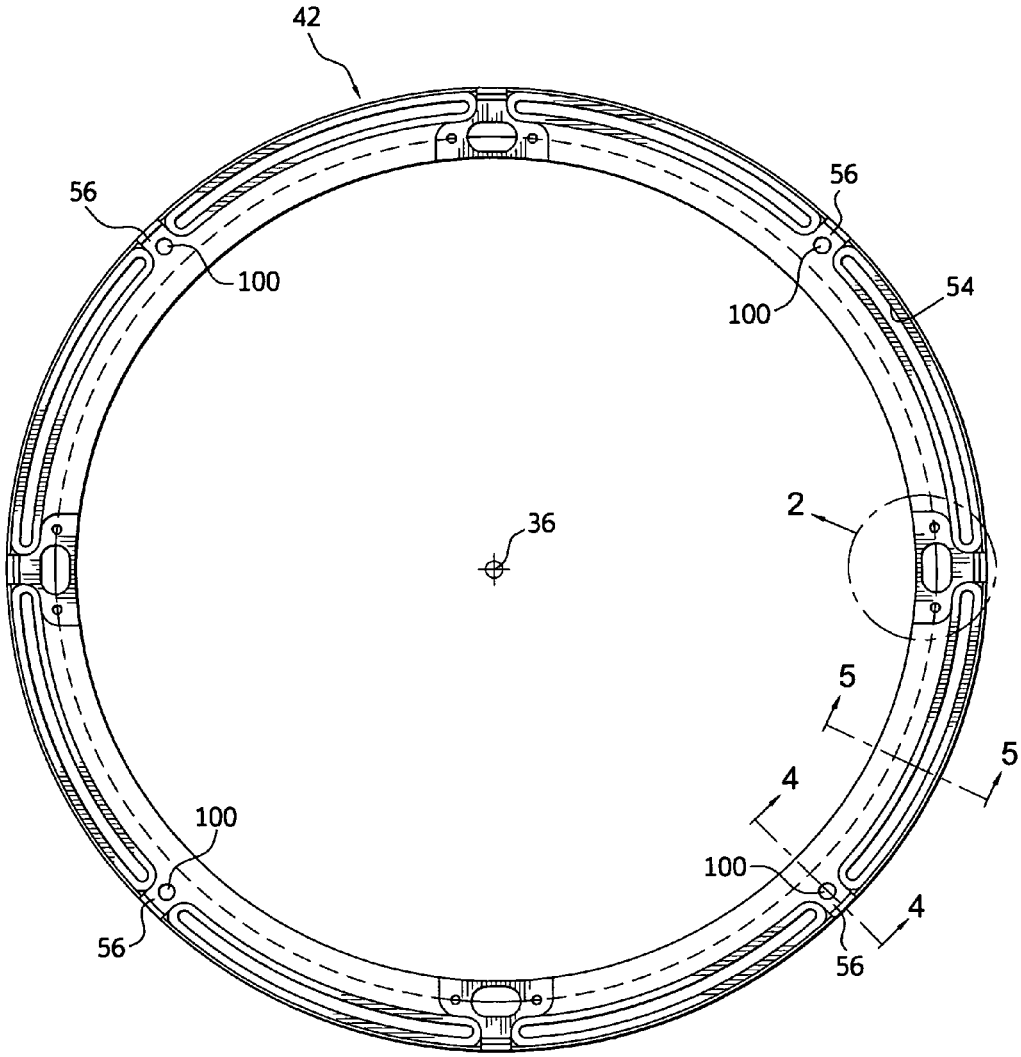
FIG. 1 is a top view of the base ring of the present quick change unit.
Figure 2:
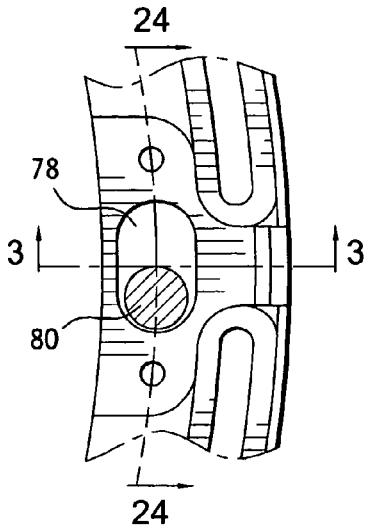
FIG. 2 is an enlarged view of the lock tab portion "2" of FIG. 1.
Figure 3:
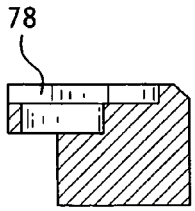
FIG. 3 is a cross-sectional view taken along line 3-3 of FIG. 2.

The present quick change head assembly allows the user to swap between any number of pre-tuned heads. The user bolts the base ring of the present assembly to the drum shell by means of the tie-down screws engaging the base ring and screwed into nut members already affixed to the outside surface of the shell. This is a permanent installation. The adapter ring (the second or middle ring), the tuner ring (the top ring) and the membrane comprise a unit which provides structure for tensioning the membrane and tuning the drum. This allows the user to pre-tune or pre-tension as many heads as desired. The base ring (or bottom ring) is bolted to the drum using the existing tie-down, tuning screw hardware and rests on the bearing edge (top open surface of the shell) where the head would normally sit.

The pre-tuned head unit can be removed with a twist, much like a jelly jar. The drummer can switch between the heads in seconds, instead of the typical 15-20 minutes a normal head change would take.

DETAILED DESCRIPTION

Referring the drawings and with particular reference to the claims herein, the present percussion instrument comprises in a preferred usage embodiment, a percussion instrument 30 fitted with a drum head quick change assembly generally designated 32, and comprising a cylindrical resonating drum shell 34 having a longitudinal axis 36, an open top end 38 and an open bottom end 40.

The quick change assembly comprises an annular base ring 42 having a flat upper surface 44, an annular vertical radially inner wall 46, an annular lateral stop shoulder 48, and a radially outer lateral annular edge 50 having an annular strengthening lip 52. Ledge 50 is formed with a series of annular slots 54 between strengthening abutments 56. These slots receive the screws 58 of a first clamping means 60 which secure the base ring to the open top 38 of the shell. Theses slots are bordered by annular lip 52 which enhances the anti-deformation strength of ledge 50 and allows any number and location of the tie-down screws to be used. This is a significant improvement over prior head constructions.

The first clamping means 60 typically comprises one component (screws) 58 which are threaded into second component (nuts) members 62 which are permanently affixed around and to the exterior surface of shell 34 by, e.g., screws or rivets. The upper ends of screws 58 pass thru slots 54 and washers 64 (preferably sound deadening) and are capped by nuts 66 which are tightened or loosened to tune the drum.

The quick change assembly 32 further comprises a drum head/tuner unit generally designated 68 and comprising an annular adapter ring 70 positioned on a top surface 72 of said base ring and having an annular upper vertical wall portion 74 and a substantially lateral, lower annular compression shoulder means 76. Cooperating components of releasable axial and rotative locking structures are provided on said base ring and said adapter ring for releasably locking said adapter ring 70 to said base ring 42 against relative axial and rotative movement. These structures can be, e.g., slot 78 in ring 42 and foot lock 80 on adapter ring 70 dimensioned to enter down into cavity 71 at one end of the slot but engage surface 73 at the other end of the slot. Surface 73 preferably is slanted to bind against 80 and press ring 70 firmly against ring 42 and minimize vibration therebetween but allowing forcible rotation of the adapter ring 70 for removal of the unit from ring 42.

A circular percussion membrane 82 having a substantially lateral peripheral, rigid, annular first shoulder means 84 is slidably mounted over the top 86 of said vertical wall portion 74 of said adapter ring. An annular tuner ring 87 having a substantially lateral, peripheral, rigid, compression shoulder means 88 is positioned over said shoulder means 84 of said percussion membrane with an annular shoulder 85 on shoulder means 88 engaging shoulder 84 on the membrane. Clamping means such as cap screws 90 are provided for engaging said adapter ring and said tuner ring and drawing said rings axially toward each other and stretching said percussion membrane a controlled amount down over said vertical wall portion 74 of said adapter ring to tune said instrument. An annular bottom rim 92 engages a resonating bottom membrane 94 covering said bottom end 40 of said shell, wherein the membrane has peripheral edge portions 96 clamped between said bottom end 40 and bottom rim 92 by means of second clamping means 98 engaging said rim 92 and said peripheral edge portions 96 of said bottom membrane.

Figure 4:
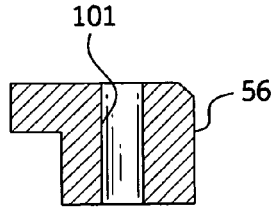
FIG. 4 is a cross-sectional view taken along line 4-4 of FIG. 1.
Figure 5:
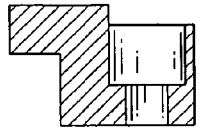
FIG. 5 is a cross-sectional view taken along line 5-5 in FIG. 1.
Figure 7:
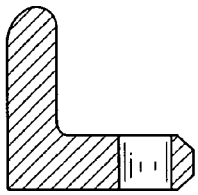
FIG. 7 is a cross-sectional view taken along line 7-7 of FIG. 6.
Figure 8:
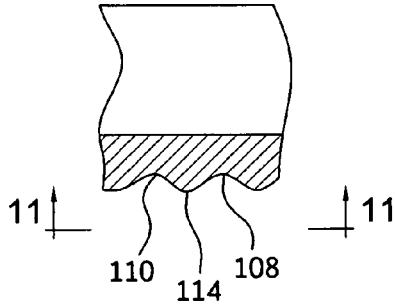
FIG. 8 is a cross-sectional view taken along line 8-8 in FIG. 6.
Figure 9:
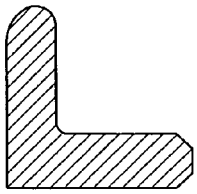
FIG. 9 is a cross-sectional view taken along line 9-9 of FIG. 6.
Figure 10:
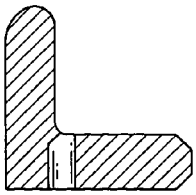
FIG. 10 is a cross-sectional view taken along line 10-10 of FIG. 6.
Figure 11:
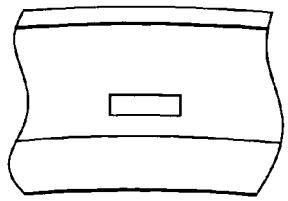
FIG. 11 is a view of the underside of the adapter ring taken along line 11-11 of FIG. 8.
Figure 6:
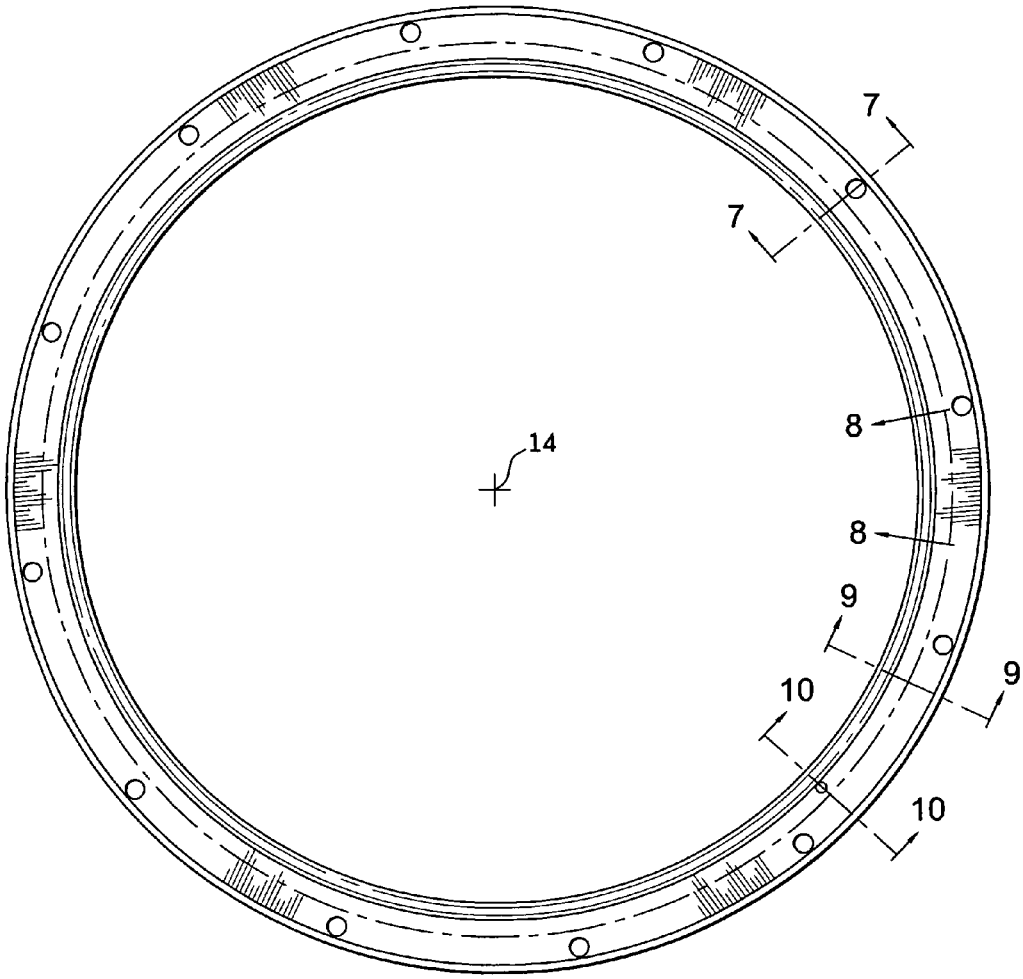
FIG. 6 is a top view of the adapter ring of the present unit.
Figure 12:
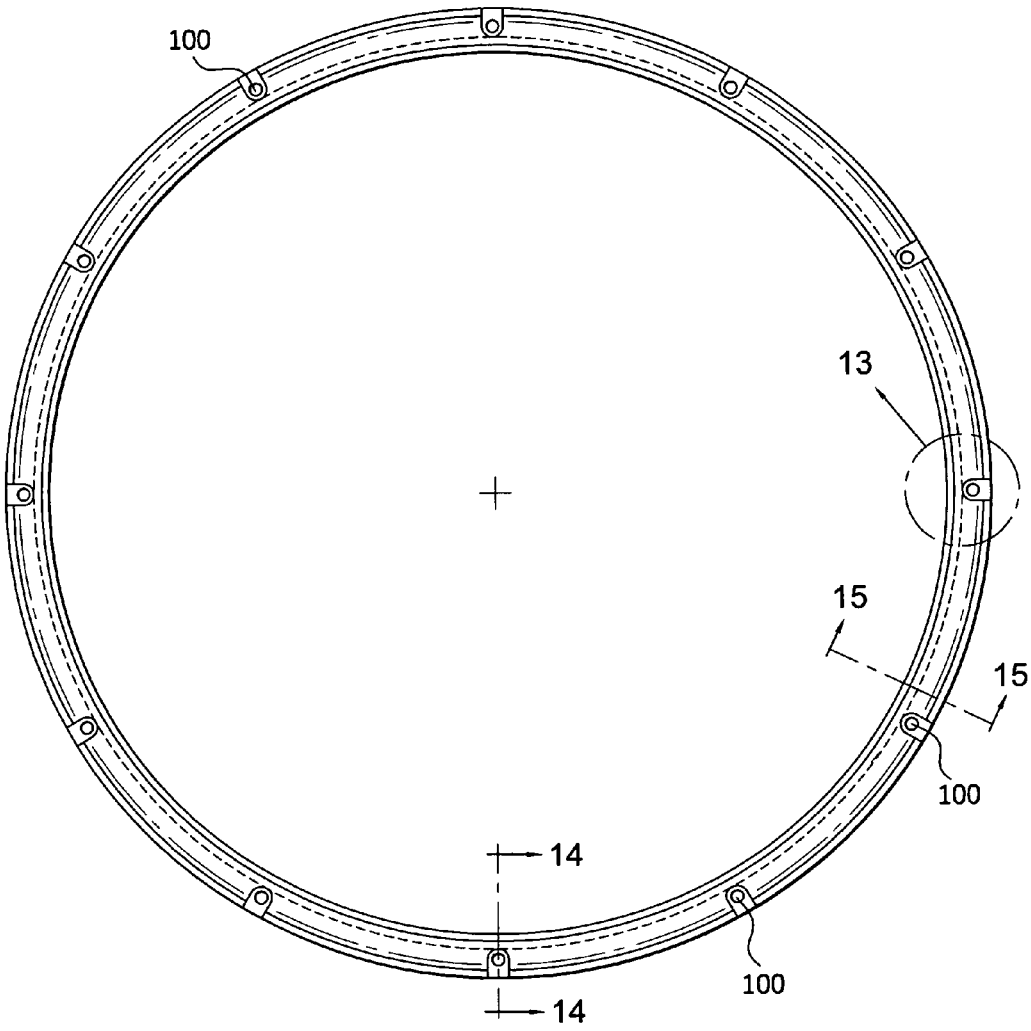
FIG. 12 is a top view of the tuner ring of the present unit.
Figure 13:
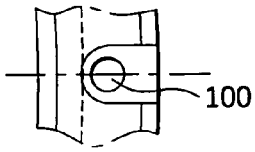
FIG. 13 is an enlarged view of portion "13" of FIG. 12.
Figure 14:
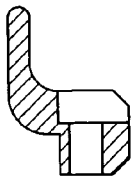
FIG. 14 is a cross-sectional view taken along line 14-14 of FIG. 12.
Figure 15:
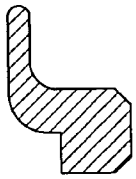
FIG. 15 is a cross-sectional view taken along line 15-15 of FIG. 12.
Figure 16:
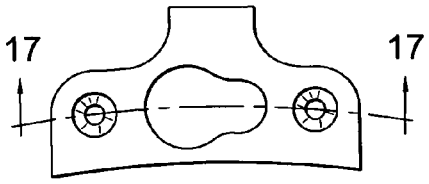
FIG. 16 is a top view of the present lock tab.
Figure 17:
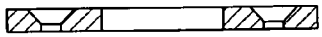
FIG. 17 is a cross-sectional view taken along line 17-17 of FIG. 16.
Figure 18:
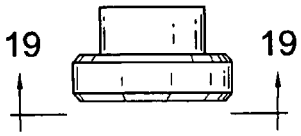
FIG. 18 is a side view of the present foot lock.
Figure 19:
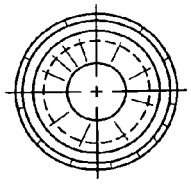
FIG. 19 is an underside view of the foot lock taken along line 19-19 of FIG. 18.
Figure 22:
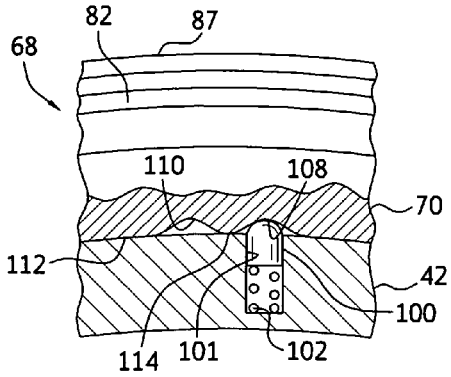
FIG. 22 is a cross-sectional view as in FIG. 8 showing a variation of the rotation stop shoulder and stop plunger.
Figure 23:
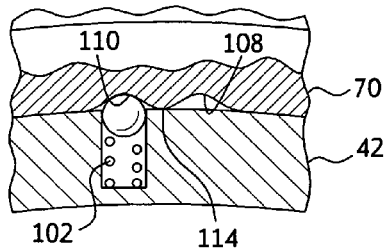
FIG. 23 shows a variation of stop plunger of FIG. 22.
Figure 20:
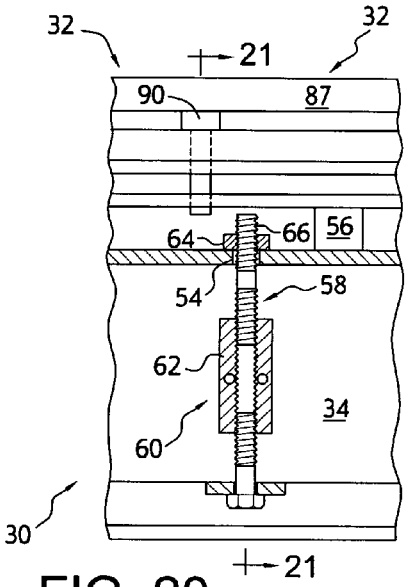
FIG. 20 is a side view of a drum fitted with the present unit.
Figure 21:
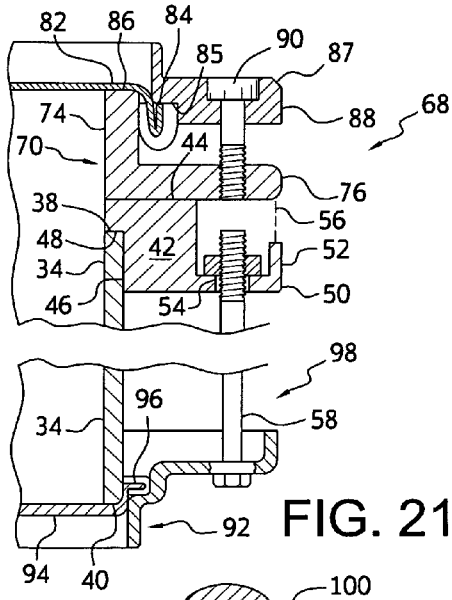
FIG. 21 is a cross-sectional view taken along line 21-21 of FIG. 20.
Figure 24:
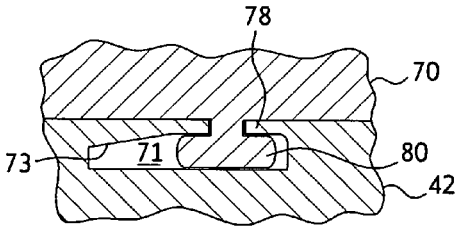
FIG. 24 is a cross-sectional view taken along line 24-24 in FIG. 2 and showing a preferred structure for the lock tab which affords anti-vibration between the base ring and adapter ring.
Figure 25:
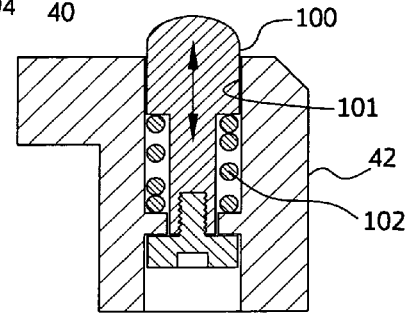
FIG. 25 is a cross-sectional view of the stop plunger of FIG. 22 and its mounting in the base ring.

The axial and rotative lock means is preferably supplemented with a cooperating pair of rotation stops which further provides frictional resistance to inopportune rotational release of the foot lock 80 from cavity 71. Referring to FIGS. 4, 22, 23, and 25, one component of each stop comprises a plunger 100 mounted in abutment 56 and urged upwardly in bearing 101 by a compression spring 102. Plunger 100 can be varied in configuration such as rod or ball. The upward travel of the plunger is limited by shoulder 104 on the plunger engaging shoulder 106 on the abutment. The other component of each stop comprises, in a preferred embodiment, a pair of recess surfaces, adapter ring release surface 108 and adapter ring lock surface 110 formed in the underside 112 of adapter ring 70 on either side of a lock ridge surface 114. The curvatures and dimensions of these surfaces allows plunger 100 to slide from 108 over 114 and on to 110 (FIG. 23) to give frictional resistance to rotation of the adapter ring to the release position. It is particularly noted that the depth of surfaces 108 and 110 avoids upward pressure by the plunger against the adapter ring which otherwise would tend to diminish the downward wedging force of surface 73 of the adapter ring anti-rotation lock.

The invention has been described in detail with particular reference to preferred embodiments thereof, but it will be understood that variations and modifications will be effected with the spirit and scope of the invention.

I claim:

1. A percussion instrument fitted with a drum head quick change head assembly and comprising a cylindrical resonating shell having a longitudinal axis, an open top end and an open bottom end, an annular base ring engaging said top end of said shell removably mounted on said top end by first clamping means mounted on exterior side surface portions of said shell and on said base ring and clamping said base ring securely to said top end of said shell, an annular adapter ring positioned on a top surface of said base ring and having a radially inner, annular, upper substantially vertical wall portion and a substantially lateral radially outer, lower annular first compression shoulder means, cooperating components of releasable axial and rotative locking structures on said base ring and said adapter ring and releasably locking said adapter ring to said base ring against relative axial and rotative movement between said base ring and adapter ring, a circular percussion membrane having a substantially lateral peripheral, rigid, annular first shoulder means slidably mounted over said substantially vertical wall portion of said adapter ring, an annular tuner ring having a radially inner, substantially lateral, annular second shoulder means positioned over said first shoulder means of said percussion membrane, said tuner ring having a substantially lateral, annular, radially outer second compression shoulder means, adjustable force clamping means engaging first and second compression shoulder means and drawing said adapter and tuner rings axially toward each other and stretching said percussion membrane a controlled amount down over said substantially vertical wall portion of said adapter ring to tune said instrument.

2. The instrument of claim 1 wherein is provided an annular bottom rim engaging said bottom end, a resonating bottom membrane covering said bottom end of said shell and having peripheral edge portions clamped between said bottom end and an annular bottom rim by means of second clamping means engaging said shell and said peripheral edge portions of said bottom membrane.

3. The instrument of claim 1 wherein said axial locking structures comprise generally laterally oriented stop shoulder means on each of said base ring and said adapter ring and constructed and positioned to allow said lateral shoulder means on said adapter ring to slide under said lateral shoulder means on said base ring upon relative rotation between said base ring and said adapter ring, and wherein said rotative locking structure comprises a spring urged stop plunger first component vertically reciprocably mounted in said base ring, and a stop ridge second component stationarily formed on said adapter ring, whereby upon said rotation said first component will ride over said second component and lodge in either a rotative lock pocket or a release position pocket.

4. The instrument of claim 1 wherein said first clamping means comprises nut structure affixed to exterior side portions of said shell and threaded posts extending thru shoulder structure provided on radially outer portions of said base ring, wherein the top end of said posts carries nuts for tightening said base ring against said top end of said shell.

5. A quick change drum head assembly for a musical drum, said assembly comprising an annular base ring for engaging a top end of a drum shell, a component of first clamping means on said base ring, an annular adapter ring positioned on a top surface of said base ring and having a radially inner, annular, upper substantially vertical wall portion and a substantially lateral radially outer, lower annular first compression shoulder means, cooperating components of releasable axial and rotative locking structures on said base ring and said adapter ring and releasably locking said adapter ring to said base ring against relative axial and rotative movement between said base ring and adapter ring, a circular percussion membrane having a substantially lateral peripheral, rigid, annular first shoulder means slidably mounted over said substantially vertical wall portion of said adapter ring, an annular tuner ring having a radially inner, substantially lateral, annular second shoulder means positioned over said first shoulder means of said percussion membrane, said tuner ring having a substantially lateral, annular, radially outer second compression shoulder means, adjustable force clamping means engaging first and second compression shoulder means and drawing said adapter and tuner rings axially toward each other and stretching said percussion membrane a controlled amount down over said substantially vertical wall portion of said adapter ring to tune said instrument.

* * * * *